US012674404B2

(12) United States Patent
Iwai

(10) Patent No.: US 12,674,404 B2
(45) Date of Patent: Jul. 7, 2026

(54) ENGINE

(71) Applicant: TOYOTA JIDOSHA KABUSHIKI KAISHA, Toyota (JP)

(72) Inventor: Takeshi Iwai, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 19/093,315

(22) Filed: Mar. 28, 2025

(65) Prior Publication Data

US 2025/0354506 A1 Nov. 20, 2025

(30) Foreign Application Priority Data

May 17, 2024 (JP) ..... 2024-081008

(51) Int. Cl.
*F01M 13/00* (2006.01)

(52) U.S. Cl.
CPC ..... *F01M 13/0011* (2013.01); *F01M 13/00* (2013.01)

(58) Field of Classification Search
CPC ..... F02M 35/10222; F02M 35/10209; F01M 13/0011; F01M 13/00
See application file for complete search history.

(56) References Cited

U.S. PATENT DOCUMENTS

2009/0301446 A1* 12/2009 Asanuma ..... F01M 13/028 123/573
2009/0308364 A1* 12/2009 Konohara ..... F02M 25/06 123/568.11
2010/0192925 A1* 8/2010 Sadakane ..... F02M 35/10216 123/90.15
2011/0073083 A1* 3/2011 Shiraishi ..... F01M 13/02 123/574
2015/0034057 A1* 2/2015 Murate ..... F02D 41/1454 123/572

FOREIGN PATENT DOCUMENTS

DE 102008005409 A1 * 10/2008 ..... F01M 13/0011
DE 102013224919 A1 * 6/2014 ..... F02B 29/0468
DE 202013008611 U1 * 9/2014 ..... F02M 25/06
DE 102014109587 A1 * 1/2015 ..... F01M 13/0011
DE 102016217686 A1 * 3/2018 ..... F02D 41/0002
DE 102017002218 A1 * 9/2018 ..... F01M 13/04
DE 102017220257 A1 * 5/2019 ..... F01M 13/00
EP 2505798 A1 * 10/2012 ..... F01M 13/022
JP 2011-185181 A 9/2011
KR 2021123546 A * 10/2021
KR 20210156998 A * 12/2021 ..... F02M 35/10222
WO WO-2013114537 A1 * 8/2013 ..... F01M 11/10

* cited by examiner

*Primary Examiner* — Hung Q Nguyen

(57) ABSTRACT

An oil pan forms a bottom portion of a crankcase of an engine. A partition wall extends upwardly from a bottom surface of the oil pan. The partition wall partitions an inside of the oil pan into a first region in which engine oil is stored and a second region in which the engine oil is not stored. An opening of an air introduction passage is arranged in the second region. The air introduction passage guides air from an intake passage to the crankcase for ventilation.

4 Claims, 4 Drawing Sheets

ENGINE

CROSS-REFERENCE TO RELATED APPLICATIONS

This application is based upon and claims the benefit of priority from Japanese Patent Application No. 2024-081008, filed on May 17, 2024, the entire contents of which are incorporated herein by reference.

BACKGROUND

1. Field

The following description relates to an engine that performs ventilation of a crankcase.

2. Description of Related Art

Japanese Laid-Open Patent Publication No. 2011-185181 discloses an engine including a ventilation system that vents blow-by gas from a crankcase by introducing air from an intake passage into the crankcase.

Engine oil is stored inside the crankcase. Accordingly, when air is introduced into the crankcase for ventilation, blowing of the introduced air may stir the engine oil. If the engine oil is stirred, air bubbles may be mixed into the engine oil and form an emulsion. In addition, the engine oil is easily atomized into a mist by stirring. Some of the oil mist is carried away from the crankcase together with the blow-by gas. Thus, the introduction of air into the crankcase for ventilation may increase engine oil consumption.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an engine is provided. The engine includes an intake passage, a crankcase, a partition wall, and an air introduction passage. The crankcase includes a bottom portion in which engine oil is stored. The partition wall extends upwardly from a bottom surface of the crankcase. The partition wall partitions the bottom portion of the crankcase into a first region in which the engine oil is stored and a second region in which the engine oil is not stored. The air introduction passage includes a first end that is open to an inner wall surface of the crankcase located in the second region, and a second end that is continuous with the intake passage. The engine is configured to perform ventilation of the crankcase by introducing air from the intake passage through the air introduction passage.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

Hereinafter, an embodiment of an engine will be described in detail with reference to FIGS. 1 to 4.

Configuration of Engine 10

Figure 1:
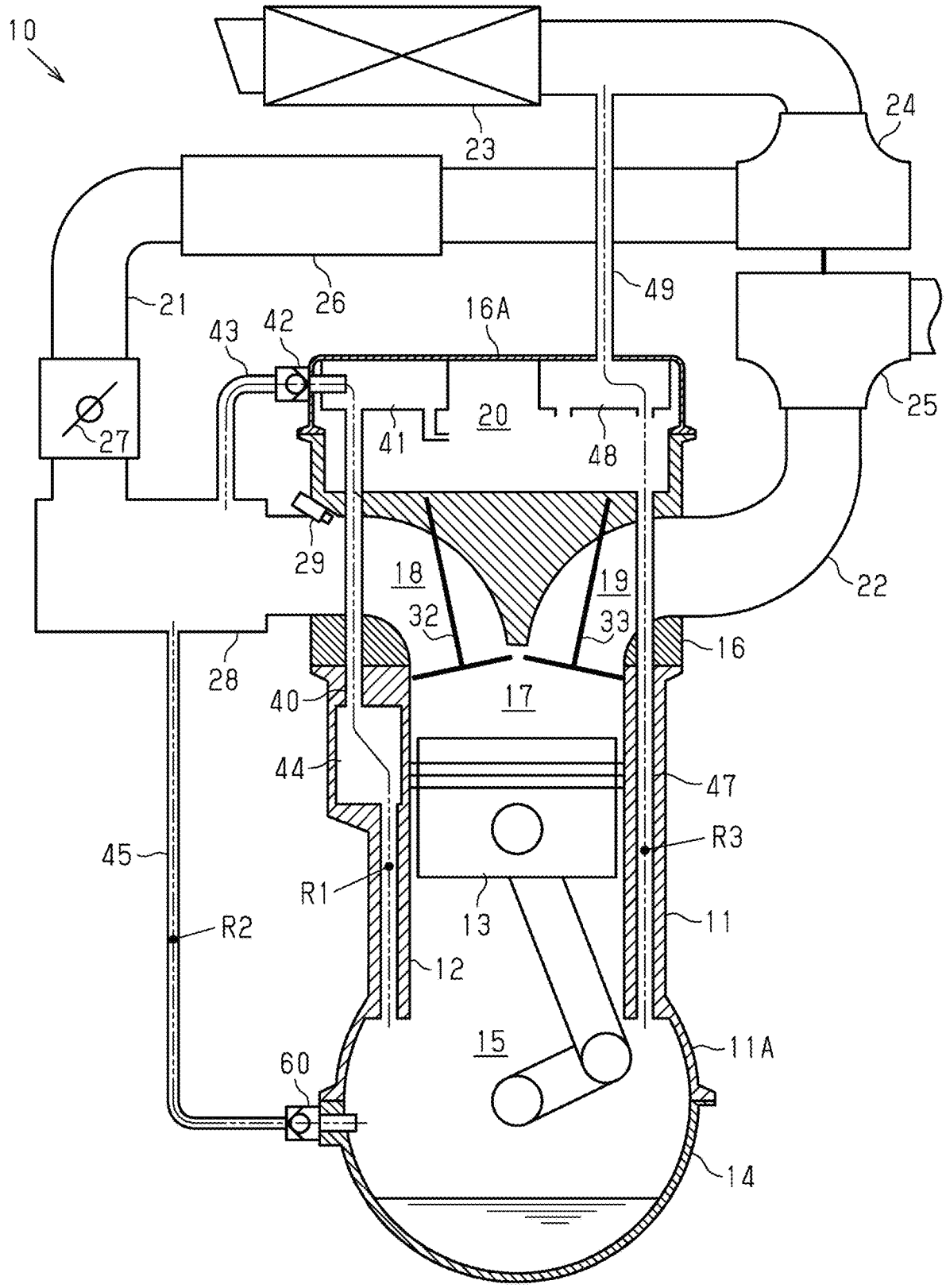
FIG. 1 is a diagram schematically showing the structure of an engine in accordance with an embodiment.

First, the configuration of the engine 10 will be described with reference to FIG. 1. The engine 10 shown in FIG. 1 is a hydrogen engine that generates power by burning hydrogen. In the case of a hydrogen engine, combustible hydrogen may be contained in the blow-by gas. For this reason, hydrogen engines are required to have higher ventilation performance for blow-by gas than gasoline engines and diesel engines.

The engine 10 includes a cylinder block 11. Cylinders 12 are formed inside the cylinder block 11. FIG. 1 shows only one of the cylinders 12. A piston 13 is accommodated in each of the cylinders 12 so as to be able to reciprocate. A combustion chamber 17 for burning hydrogen is formed in a portion of the cylinder 12 above the piston 13.

A cylinder head 16 is mounted on the upper part of the cylinder block 11. Inside the cylinder head 16, an intake port 18 and an exhaust port 19 are formed for each cylinder 12. A head cover 16A is mounted on the upper side of the cylinder head 16. A valve operating chamber 20 that houses a valvetrain is formed inside the upper part of the cylinder head 16, covered by the head cover 16A.

An oil pan 14 is attached to the bottom of the cylinder block 11. A crankcase 15 is defined by the skirt portion 11A of the cylinder block 11 and the oil pan 14. Engine oil is stored in the oil pan 14 constituting the bottom portion of the crankcase 15.

The engine 10 includes an intake passage 21, through which air is drawn into the combustion chamber 17, and an exhaust passage 22, through which exhaust gas is discharged from the combustion chamber 17. The intake passage 21 includes an air cleaner 23 that filters dust or the like from the air. The portion of intake passage 21 downstream of the air cleaner 23 includes a compressor 24. The compressor 24 constitutes a turbocharger together with a turbine 25 installed in the exhaust passage 22. The portion of the intake passage 21 downstream of the compressor 24 includes an intercooler 26. The intercooler 26 is a heat exchanger for cooling the air heated to a high temperature by the compression in the compressor 24. A throttle valve 27 is disposed in the intake passage 21 downstream of the intercooler 26. The throttle valve 27 is a valve for adjusting the flow rate of air sent to the combustion chamber 17 through the intake passage 21. The intake passage 21 branches for each cylinder 12 in an intake manifold 28 that is located downstream of the throttle valve 27. The intake manifold 28 is connected to the combustion chamber 17 through the intake port 18.

The engine 10 is provided with an injector 29 for injecting hydrogen into air used for combustion in the combustion chamber 17. In FIG. 1, the injector 29 is disposed to inject hydrogen into the intake port 18. Instead, the injector 29 may be disposed to inject hydrogen into the combustion chamber 17. The engine 10 further includes an intake valve 32 that opens and closes the intake port 18 with respect to the combustion chamber 17, and an exhaust valve 33 that opens and closes the exhaust port 19 with respect to the combustion chamber 17.

Ventilation System

The engine 10 includes a ventilation system for the crankcase 15. The ventilating system is provided with three passages of a first passage R1, a second passage R2, and a third passage R3 as passages for communicating the intake passage 21 with the crankcase 15.

The first passage R1 communicates a portion of the intake passage 21 downstream of the throttle valve 27 with the crankcase 15. The first passage R1 is constituted by the blow-by gas passage 40, the first separators 41, the PCV valve 42, the first PCV hose 43, and the second separators 44. The first and second separators 41 and 44 are separators that separate oil mist from the blow-by gas flowing through the first passage R1. The first separator 41 is mounted on the inner side of the head cover 16A. The blow-by gas passage 40 is a passage that passes through the inside of the cylinder block 11 and the cylinder head 16 and connects the crankcase 15 and the first separator 41. The second separator 44 is provided in an intermediate portion of the blow-by gas passage 40 in the cylinder block 11. The first PCV hose 43 is a hose that connects the first separator 41 and the intake manifold 28. The PCV valves 42 allow the flow of gas from the inside of the crankcase 15 to the intake passage 21 through the first passage R1, and restrict the flow of gas from the intake passage 21 to the inside of the crankcase 15 through the first passage R1. The PCV valve 42 is installed at a connection portion of the first PCV hose 43 to the first separator 41.

The second passage R2 communicates a portion of the intake passage 21 downstream of the compressor 24 with the crankcase 15. In the case of FIG. 1, the second passage R2 is configured to communicate between the intake manifold 28 and the crankcase 15. The second passage R2 is constituted by the second PCV hose 45 and the one-way valve 60. The second PCV hose 45 is a hose that connects the crankcase 15 and the intake manifold 28. The one-way valve 60 allows the flow of air from the intake passage 21 to the crankcase 15 through the second passage R2, and restricts the flow of gas from the crankcase 15 to the intake passage 21 through the second passage R2. In the case of the engine 10 of the present embodiment, the second passage R2 corresponds to an air introduction passage whose first end communicates with the intake passage 21 and whose second end opens to the inside of the crankcase 15. In the engine 10 of the present embodiment, the one-way valve 60 is attached to the crankcase 15. The attachment structure of the one-way valve 60 to the crankcase 15 will be described in detail later.

The third passage R3 communicates a portion of the intake passage 21 upstream of the compressor 24 with the crankcase 15. The third passage R3 is constituted by the oil return passage 47, the valve operating chamber 20, the third separator 48, and the third PCV hose 49. The oil return passage 47 is a passage that passes through the inside of the cylinder block 11 and the cylinder head 16 to communicate the valve operating chamber 20 with the crankcase 15. The oil return passage 47 functions as a passage for returning oil from the valve operating chamber 20 to the oil pan 14, and also functions as a passage for circulating gas between the valve operating chamber 20 and the crankcase 15. The third separators 48 are separators that separate oil mist in the blow-by gas flowing through the third passage R3. The third separator 48 is disposed on the inner side of the head cover 16A. The third PCV hose 49 is a hose that connects a portion of the intake passage 21 downstream of the air cleaner 23 and upstream of the compressor 24 to the third separator 48.

During the natural aspiration operation of the engine 10, a portion of the intake passage 21 downstream of the throttle valve 27 has a negative pressure. Due to this negative pressure, the blow-by gas in the crankcase 15 is sucked into the intake passage 21 through the first passage R1. In addition, air is introduced into the crankcase 15 through the third passage R3. On the other hand, during the supercharging operation of the engine 10, a portion of the intake passage 21 downstream of the compressor 24 has a positive pressure. At this time, the air having a positive pressure is introduced into the crankcase 15 from the intake passage 21 through the second passage R2. Then, the blow-by gas in the crankcase 15 is pushed out by the introduced air and is discharged to the intake passage 21 through the third passage R3.

Attachment Structure for One-Way Valve 60

Figure 2:
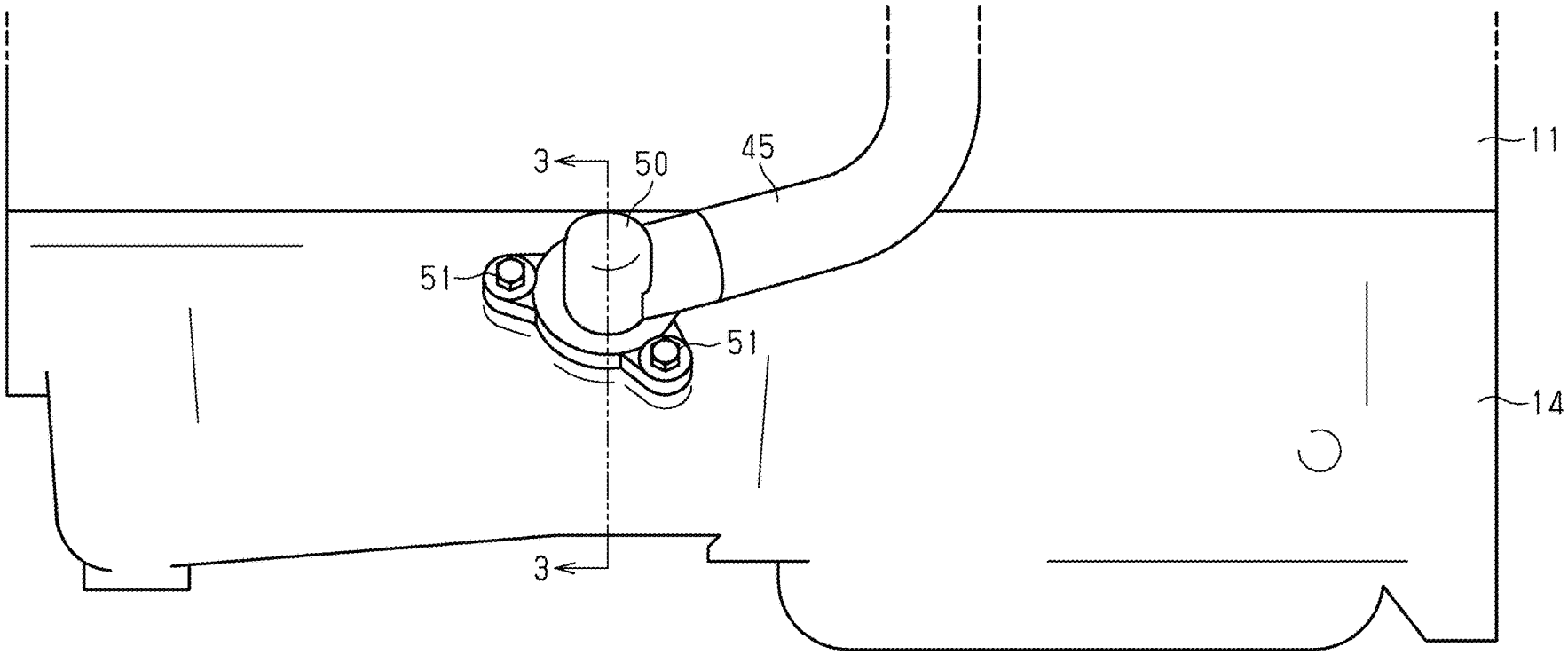
FIG. 2 is a side view of an oil pan of the engine and its periphery.
Figure 3:
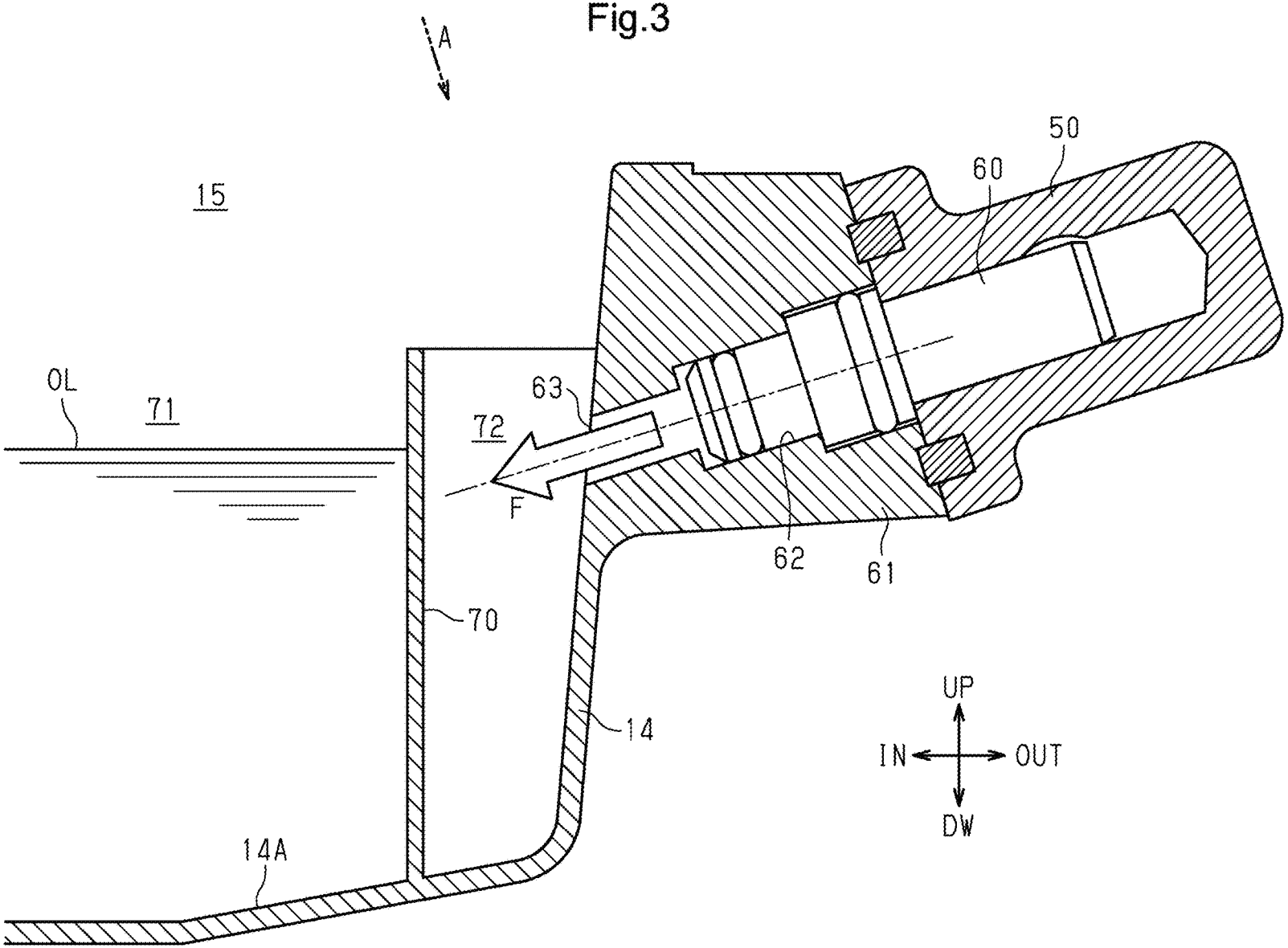
FIG. 3 is a cross-sectional view showing the cross-sectional structure of the engine taken along line 3-3 in FIG. 2.

In the case of the engine 10 of the present embodiment, the one-way valve 60 that restricts the flow direction of the gas in the second passage R2 is directly attached to the crankcase 15. Hereinafter, a structure for attaching the one-way valve 60 to the crankcase 15 will be described with reference to FIGS. 2 and 3. FIG. 2 is a side view of the oil pan 14 of the engine 10 and the vicinity thereof. FIG. 3 shows a cross-sectional structure of the valve housing 50 and its vicinity taken along line 3-3 of FIG. 2.

In the following description, the state of the engine 10 when the vehicle on which the engine 10 is mounted is stationary on a horizontal plane will be referred to as the state of the engine 10 when mounted on the vehicle. In addition, the liquid surface of the engine oil in the crankcase 15 when the engine oil is injected into the engine 10 in an amount corresponding to the upper limit of the appropriate range in the vehicle-mounted state is referred to as a reference oil level OL. Furthermore, in the one-way valve 60, a side on which a discharge port of air to the inside of the crankcase 15 is provided is referred to as a distal end side of the one-way valve 60, and the opposite side is referred to as a proximal end side of the one-way valve 60.

In FIG. 3, the directions of the mounting upper side UP, the mounting lower side DW, the case inner side IN, and the case outer side OUT are indicated by arrows. The mounting upper side UP and the mounting lower side DW respectively represent a vertically upper side and a vertically lower side when the engine 10 is mounted on the vehicle. A case inside IN indicates a direction from the outside to the inside of the crankcase 15 in the horizontal direction at the time of mounting, and a case outside OUT indicates a direction from the inside to the outside of the crankcase 15 in the horizontal direction at the time of mounting. The horizontal direction at the time of mounting represents a horizontal direction in a cross section shown in FIG. 3 in a state in which the engine 10 is mounted on the vehicle.

As shown in FIG. 2, the engine 10 includes a valve housing 50 for attaching the one-way valve 60 to the crankcase 15. The valve housing 50 is fixed to the outer wall of the oil pan 14 by a bolt 51. In the case of FIG. 2, the valve housing 50 is fixed by two bolts 51. The valve housing 50 may be fixed by one bolt 51 or three or more bolts 51. Further, the valve housing 50 may be fixed to the crankcase 15 by a method other than the bolt 51. The second PCV hose 45 is connected to the crankcase 15 via a valve housing 50.

As shown in FIG. 3, a boss 61 is arranged at a portion of the oil pan 14 where the one-way valve 60 and the valve housing 50 are mounted. The boss 61 includes an insertion hole 62 that connects the inside and the outside of the crankcase 15. A distal end portion of the one-way valve 60 is inserted into the insertion hole 62. A basal end portion of the one-way valve 60 protruding from the insertion hole 62 is covered by the valve housing 50. The one-way valve 60 is attached to the crankcase 15 in a state sandwiched between the oil pan 14 and the valve housing 50. The oil pan 14 forms an outer wall of the crankcase 15. As shown in FIG. 3, the one-way valve 60 is attached to the crankcase 15 so that the distal end side of the one-way valve 60 is facing obliquely downward. This avoids interference of the one-way valve 60 with peripheral components, and readily ejects oil out of the one-way valve 60. The air discharged from the one-way valve 60 flows through the insertion hole 62 into the crankcase 15 without changing its direction. Therefore, an opening 63 of the insertion hole 62 arranged in an inner wall of the crankcase 15 corresponds to an opening of the second passage R2 inside the crankcase 15. Air is discharged from the opening 63 into the crankcase 15 in a direction F shown in the drawing. The direction F is a direction in which the discharged air approaches the liquid surface of the engine oil in a state in which the engine 10 is mounted on a vehicle.

Partition Wall 70

As shown in FIG. 3, a partition wall 70 is arranged on the oil pan 14, which forms the bottom portion of the crankcase 15. The partition wall 70 extends upwardly from a bottom surface 14A of the oil pan 14 that forms a bottom surface of the crankcase 15. The partition wall 70 includes an upper end located upward UP from the reference oil level OL in a state in which the engine 10 is mounted on a vehicle. Also, the upper end of the partition wall 70 is located upward UP from the opening 63.

Figure 4:
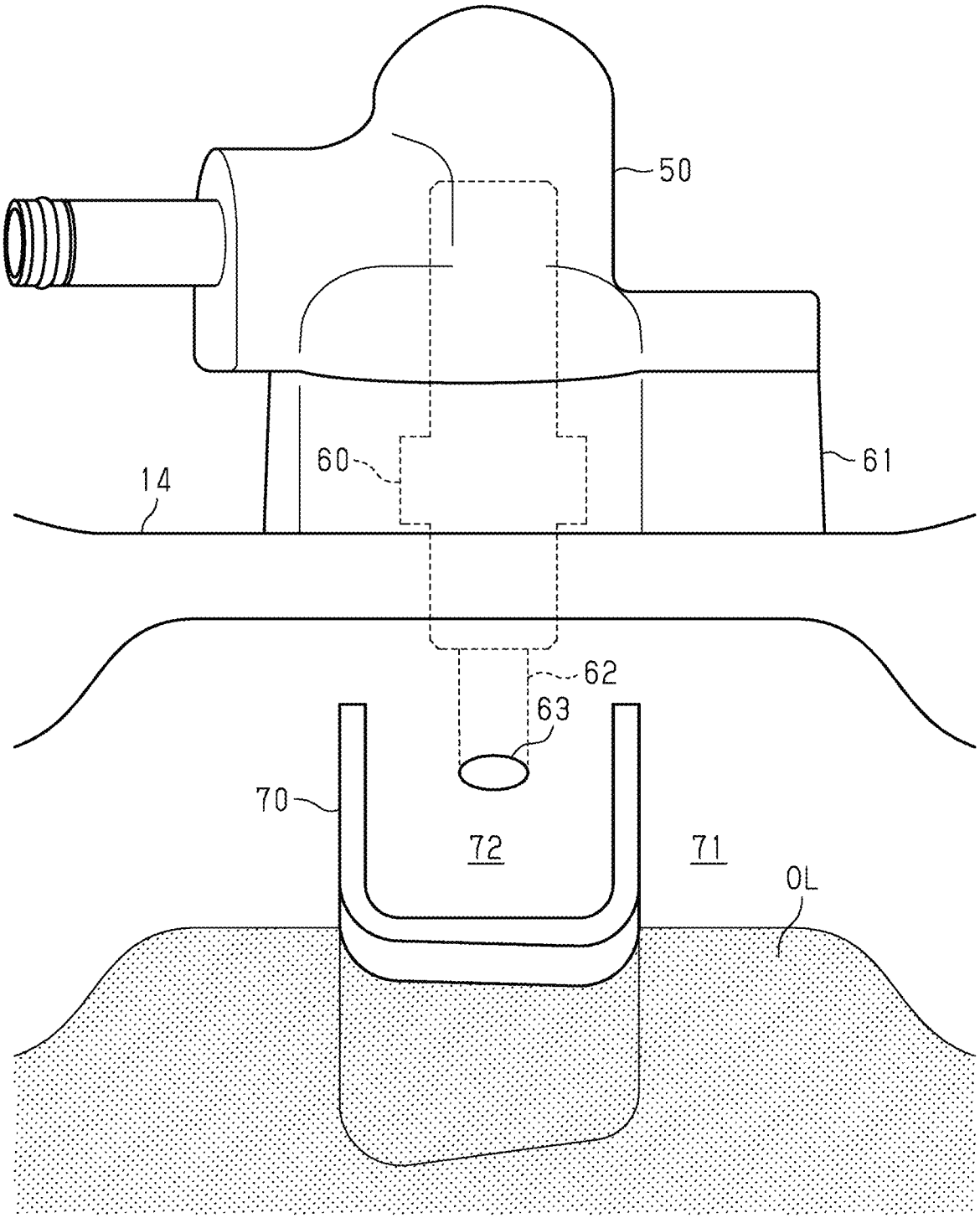
FIG. 4 is a view of a partition wall of the engine and its periphery as viewed in a direction of arrow A in FIG. 3.

FIG. 4 shows the partition wall 70 and its periphery as viewed in a direction of arrow A shown in FIG. 3. The partition wall 70 is arranged around the opening 63 that is formed in the inner wall of the crankcase 15. The partition wall 70 and the oil pan 14 may be formed as a one-piece component. Alternatively, the partition wall 70 may be formed as a separate component from the oil pan 14.

The inside of the oil pan 14, which forms the bottom portion of the crankcase 15, is partitioned into a first region 71 outside the partition wall 70 and a second region 72 inside the partition wall 70. In the engine 10 of the present embodiment, the engine oil is injected into only the first region 71.

Operation of the Embodiment

The engine 10 of the present embodiment includes the second passage R2 that connects the intake passage 21 and the inside of the crankcase 15. During forced-induction operation, the engine 10 ventilates the crankcase 15 by introducing air from the intake passage 21 through the second passage R2.

The engine 10 includes the partition wall 70 upwardly extending from the bottom surface 14A of the crankcase 15. The partition wall 70 partitions the bottom portion of the crankcase 15 into the first region 71 in which the engine oil is stored and the second region 72 in which the engine oil is not stored. The second passage R2, which serves as a ventilation air passage, is structured so that the first end of the second passage R2 is open to an inner wall surface of the crankcase 15 located in the second region 72, and the second end of the second passage R2 is continuous with the intake passage 21. Thus, the air introduced from the intake passage 21 through the second passage R2 is discharged to the second region 72 in which the engine liquid is not stored.

Advantages of the Embodiment

The engine 10 of the present embodiment has the following advantages.

(1) The engine 10 of the present embodiment includes the partition wall 70 that partitions the bottom portion of the crankcase 15 into the first region 71 in which the engine oil is stored and the second region 72 in which the engine oil is not stored. The opening 63 of the second passage R2 is arranged in the second region 72. The second passage R2 serves an air introduction passage that guides air from the intake passage 21 into the crankcase 15. In such an engine 10, the air introduced into the crankcase 15 through the second passage R2 is discharged to the second region 72 in which the engine liquid is not stored. As a result, the engine oil will not be stirred during ventilation of the crankcase 15.

(2) The blowing of the ventilation air to the liquid surface of the engine oil can also be suppressed by devising the position of the opening 63 and the discharge direction of the air from the opening 63. However, in such a case, the attachment position and the attachment posture of the one-way valve 60 are limited. In the case of the engine 10 of the present embodiment, blowing of air for ventilation to the liquid surface of the engine oil is suppressed by the partition wall 70. Therefore, the degree of freedom of the attachment position and the attachment posture of the one-way valve 60 is increased. For example, in the case of the engine 10 of the present embodiment, the one-way valve 60 is attached in a posture in which air is discharged obliquely downward toward the inside of the crankcase 15 in a state in which the engine 10 is mounted on the vehicle. Thus, the one-way valve 60 is prevented from interfering with surrounding components and the like.

(3) The one-way valve 60 is directly attached to the crankcase 15. More specifically, the engine 10 includes a valve housing 50 fixed to an outer wall of the crankcase 15. The one-way valve 60 is attached to the crankcase 15 in a state of being sandwiched between the crankcase 15 and the valve housing 50. In such an engine 10, the one-way valve 60 is warmed by heat received from the crankcase 15. Therefore, the occurrence of emulsion or freezing in the one-way valve 60 due to a low temperature is suppressed.

Other Embodiments

The above embodiment may be modified as described below. The above embodiment and the following modifications can be combined as long as they remain technically consistent with each other.

As long as the inflow of the engine oil from the first region 71 to the second region 72 can be prevented, the shape or the like of the partition wall 70 may be appropriately changed.

The one-way valve 60 may be attached to the crankcase 15 in a posture different from that of the above embodiment.

The attachment structure and the attachment position of the one-way valve 60 may be changed. For example, the one-way valve 60 may be directly attached to the crankcase 15 by screwing or the like without providing the valve housing 50. Further, the one-way valve 60 may be attached to a portion other than the crankcase 15.

The configuration of the ventilating system of the engine 10 can be appropriately changed as long as the ventilating system includes the second passage R2 provided with the one-way valve 60. For example, when it is not necessary to ventilate the crankcase 15 during the natural aspiration operation, the first passage R1 may be omitted.

The engine 10 is not limited to a hydrogen engine.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An engine comprising:

an intake passage;

a crankcase including a bottom portion in which engine oil is stored;

a partition wall extending upwardly from a bottom surface of the crankcase, the partition wall partitioning the bottom portion of the crankcase into a first region in which the engine oil is stored and a second region in which the engine oil is not stored; and an air introduction passage including a first end that is open to an inner wall surface of the crankcase located in the second region, and a second end that is continuous with the intake passage, wherein the engine is configured to perform ventilation of the crankcase by introducing air from the intake passage through the air introduction passage.

2. The engine according to claim 1, further comprising:

a one-way valve attached to the crankcase, the one-way valve being configured to restrict a gas flow from an inside of the crankcase toward the intake passage through the air introduction passage.

3. The engine according to claim 2, wherein the one-way valve is attached to the crankcase such that the one-way valve discharges air obliquely downward into the crankcase in a state in which the engine is mounted on a vehicle.

4. The engine according to claim 2, further comprising:

a valve housing fixed to an outer wall of the crankcase, wherein the one-way valve is attached to the crankcase in a state sandwiched between the outer wall of the crankcase and the valve housing.

* * * * *